US008167576B2

(12) United States Patent
Buccheri et al.

(10) Patent No.: US 8,167,576 B2
(45) Date of Patent: May 1, 2012

(54) METHOD FOR MANUFACTURING THE ROTOR ASSEMBLY OF A ROTATING VACUUM PUMP

(75) Inventors: Gianluca Buccheri, Syracuse (IT); Aldo Crisi, Turin (IT); Vincenzo Pandolfo, Turin (IT)

(73) Assignee: Agilent Technologies, Inc., Santa Clara, CA (US)

( * ) Notice: Subject to any disclaimer, the term of this patent is extended or adjusted under 35 U.S.C. 154(b) by 567 days.

(21) Appl. No.: 12/392,969

(22) Filed: Feb. 25, 2009

(65) Prior Publication Data

US 2009/0214348 A1 Aug. 27, 2009

(30) Foreign Application Priority Data

Feb. 27, 2008 (EP) ..... 08425120

(51) Int. Cl.
*F04D 29/02* (2006.01)

(52) U.S. Cl. ..... 416/244 R; 416/244 A; 29/598

(58) Field of Classification Search ..... 416/244 R, 416/244 A; 415/90, 143, 216.1; 29/598
See application file for complete search history.

(56) References Cited

U.S. PATENT DOCUMENTS

| | | | | |
|---|---|---|---|---|
| 4,424,003 | A | 1/1984 | Brobeck | |
| 4,778,345 | A | 10/1988 | Ito et al. | |
| 7,892,320 | B2 * | 2/2011 | Cho et al. | 95/19 |

FOREIGN PATENT DOCUMENTS

| | | | |
|---|---|---|---|
| EP | 0142334 | A | 5/1985 |
| EP | 0773367 | A1 | 1/1996 |
| EP | 1484508 | A2 | 4/2004 |
| EP | 1621774 | A2 | 4/2005 |
| GB | 1422426 | | 6/1973 |
| WO | WO 2006/048379 | A | 5/2006 |

* cited by examiner

*Primary Examiner* — Gary F. Paumen

(57) ABSTRACT

A rotor assembly for rotary vacuum pumps has improved mechanical characteristics and low manufacturing cost due to a one-step thermal coupling of a rotor having a male axial projection and its supporting shaft having an end portion comprising a female cavity with a shape and size for receiving the male projection with interference at an ambient temperature. The rotor and the shaft are made of different materials. Heating of the end portion of the shaft provides expansion of the female cavity and allows for inserting the mail projection of the rotor into the female cavity of the shaft. By cooling the end portion to the ambient temperature the contraction of the cavity is obtained forming fixed interference coupling between the shaft and the rotor, where the end portion of the shaft contracts and compresses about the male axis projection of the rotor.

20 Claims, 2 Drawing Sheets

METHOD FOR MANUFACTURING THE ROTOR ASSEMBLY OF A ROTATING VACUUM PUMP

CROSS REFERENCE TO RELATED APPLICATIONS

The subject patent application claims priority to European Patent Application No. 08425120.6 filed in the European Patent Office on Feb. 27, 2008.

FIELD OF THE INVENTION

The present invention relates to a method of manufacturing the rotor assembly of a rotary vacuum pump. More particularly, the invention relates to a method of manufacturing the rotor assembly of a turbomolecular rotary vacuum pump.

Generally, the term "rotor assembly", as used herein, means the whole of the rotor or impeller of a rotary vacuum pump and the supporting shaft associated therewith.

Examples of turbomolecular pumps are disclosed in the European patents EP 0773367 and EP 1484508.

In the field of turbomolecular vacuum pumps, in some cases, especially in small size pumps, the rotor and its supporting shaft can be made of the same material, e.g. an aluminium alloy, and the rotor assembly can therefore be manufactured as an integral piece. Yet, in medium and large vacuum pumps, in order to increase the pump performance, it is highly preferable that the rotor and its supporting shaft are made of different materials.

More particularly, taking into account the extremely high rotation speed attained by the rotor of a turbomolecular vacuum pump (generally exceeding $3\times10^4$ rpm and often close to $1\times10^5$ rpm), clearly it is necessary to minimise the masses of the rotating components, while maintaining at the same time a resistance and a rigidity as high as possible especially for the supporting shaft, since the latter is the part being the mostly stressed during the operation of the pump. For that reason, rotor assemblies for turbomolecular pumps, comprising a rotor made of a light alloy, e.g. an aluminium alloy, and a supporting shaft made of stainless steel, have been manufactured in the past.

According to the prior art, in case the rotor and the shaft are made of aluminium and steel, respectively, the coupling between the rotor and its supporting shaft is achieved by press fitting the steel shaft, equipped to this aim with a male cylindrical projection, into a female cylindrical cavity formed in the rotor body. In order to ensure the necessary interference in the coupling between the rotor and the shaft, the diameter of the rotor cavity shall necessarily be smaller than that of the shaft projection. Such interference must be ensured in all operating conditions of the rotor assembly. Thus, both deformations due to temperature variations and deformations related to the centrifugal force, the rotor assembly is subjected to during the pump operation are to be taken into account when choosing the diameters of the male projection and the female cavity.

Due to the higher thermal expansion coefficient of aluminium with respect to steel, the increase in the temperature of the rotor of aluminium during its operation will result in a loss of interference between the female cavity in the rotor and the male projection in the shaft, with a consequent risk of vibrations and misalignments or loss of the axial constraint of the rotor.

In order to compensate for the above phenomenon, it is therefore necessary to assemble the rotor assembly with a very high interference at ambient temperature.

During manufacture of the rotor assembly, in order to obtain the necessary allowance for coupling the rotor and the shaft, the rotor of aluminium alloy is therefore to be heated to a temperature above 200° C. and at the same time the shaft of steel is to be cooled to a temperature of about −80° C.

That known procedure entails however several drawbacks. First, heating the aluminium rotor to a high temperature entails a deterioration of the mechanical characteristics, in particular of the tensile yield point. Second, in order to maintain a good interference in any operating condition, that is for instance even when the rotor operates at high temperatures because of the heating caused by the friction with gas being pumped, it is necessary to provide for a very high interference at nominal conditions, that is when the rotor is stationary, with a resulting risk of a stress close to the yield point of the material of the rotor. Such very high stress levels enhance moreover the non-isotropic properties of the aluminium alloy forming the rotor. Third, since heating the rotor is not sufficient per se, and also cooling the steel shaft to a temperature well below 0° C. is required, use of expensive equipment using liquid nitrogen is necessary.

A further drawback of the prior art described above is related to the irreversibility of the coupling process, so that any error made while manufacturing the rotor assembly entails rejecting the defective piece. This latter drawback is even more serious if one considers that it takes place at the end of the manufacturing process of the rotor assembly and entails rejection of already finished, expensive semi-manufactured pieces.

In the past, in order to overcome the drawbacks of the method described above, it has been proposed to manufacture a rotor of aluminium having a suitable male projection, and a supporting shaft of steel having a corresponding female cavity intended to receive the male projection of the rotor. According to such a solution, it is the rotor projection that penetrates into the shaft cavity, and not vice versa.

Since interference increases as temperature increases, due to the higher thermal expansion coefficient of aluminium with respect to steel, such a solution in which the male portion is made of aluminium has the advantage of requiring a lower interference at ambient temperature.

WO 2006/048379 discloses a method of manufacturing a rotor assembly for a vacuum pump, comprising a rotor having a male projection and a shaft in which a corresponding female cavity is formed. This method comprises the following steps: placing a shaft, having an axial cavity, into a mould for the rotor, filling the mould and the shaft cavity with the casting material, in fluid state, of which the rotor is to be made, and finally removing the rotor assembly obtained in this manner, once it has cooled, from the mould.

As an alternative, this method comprises the steps of placing a shaft having an axial cavity into a forge die for the rotor, filling the die and the shaft cavity with the rotor forging material, in incandescent state, and finally removing the rotor assembly obtained in this manner, once it has cooled, from the die.

Both methods described above have a considerable drawback that they require heating the aluminium alloy forming the rotor to a very high temperature, with a consequent risk of deterioration of the mechanical properties.

GB 1,422,426 discloses a method of manufacturing a centrifugal compressor comprising a rotor made of light alloy and a shaft made of steel. The method comprises the steps of providing the rotor with a male frusto-conical projection and the shaft with a corresponding female frusto-conical cavity. In order to obtain the coupling of the rotor with the shaft, the rotor projection is initially inserted into the shaft cavity; then a pressurised fluid (water or oil) is introduced into the cavity through a duct so as to cause expansion of the same cavity and allowing the rotor projection to wholly penetrate into the cavity. Lastly, the shaft cavity is allowed to return to its initial size, so that the walls of the cavity block the rotor projection.

This is a very complex method, which demands the use of specific equipment. Moreover, it would not be suitable for applications in the field of turbomolecular pumps for several reasons: first, the presence of oil or water residuals could pollute the environment under vacuum; moreover, the presence of a duct for introducing pressurised fluid would result in an unbalance in the mass distribution of the shaft, with very serious consequences, taking into account the extremely high rotation speed of the rotor.

EP 1,621,774 discloses a turbo-compressor comprising a rotor of titanium aluminide equipped with a male projection introduced and locked inside a female cavity formed in a metal shaft. The coupling between the rotor and the shaft is obtained due to the combination of the geometrical interference and the brazing of the male and female elements.

Such a method has however the drawback of being irreversible, due to the brazing, whereby it does not allow recovering faulty pieces. Moreover, also in this case, application to turbomolecular vacuum pumps would be impossible, since the introduction of loose brazing material and the subsequent chaotic distribution of said material between the shaft and the rotor could result in lack of uniformity in the mass distribution, and hence to unbalances that, taking into account the high rotation speeds, could have dreadful consequences when the rotor is rotated at extremely high speed.

It is the main object of the present invention to provide a method of manufacturing a rotor assembly of the kind comprising a rotor made of a light material, e.g. an aluminium alloy, and a shaft made of a rigid material, for instance steel, which method is easy to be performed, is easily reversible and allows obtaining a rotor assembly with enhanced characteristics.

It is another object of the present invention to provide a method of manufacturing a rotor assembly, which method allows reducing the manufacturing costs.

It is a further object of the present invention to provide a method allowing for manufacturing a rotor assembly with high mechanical characteristics, which is capable of being rotated at a speed exceeding $3\times10^4$ rpm and up to about $1\times10^5$ rpm, and which is consequently applicable to turbomolecular vacuum pumps.

The above and other objects are achieved by the invention as disclosed in the detailed description and claimed in the appended claims.

SUMMARY OF THE INVENTION

The present invention is directed to the method for manufacturing the rotor assembly and the rotor assembly produced by this method. According to the invention, the only thermal treatment envisaged during the coupling step between the rotor and the shaft is heating the steel shaft, resulting in a reduction in the process costs.

Advantageously, according to the invention, the stress levels induced in the materials of the rotor assembly, and especially of the rotor body made of aluminium alloy, are at least 30% below the yield point.

Advantageously, according to the method of the invention, the process of coupling the rotor and the supporting shaft is easily reversible, by cooling the same rotor. In this manner, it is possible to recover the rotor and the supporting shaft in case of alignment errors made during the coupling step, thereby reducing the number of rejected pieces and consequently reducing the overall manufacturing costs.

BRIEF DESCRIPTION OF THE DRAWINGS

Some preferred embodiments of the method will be described hereinafter by way of non limiting examples, with reference to the accompanying drawings, in which.

DETAILED DESCRIPTION OF THE INVENTION

Figure 1:
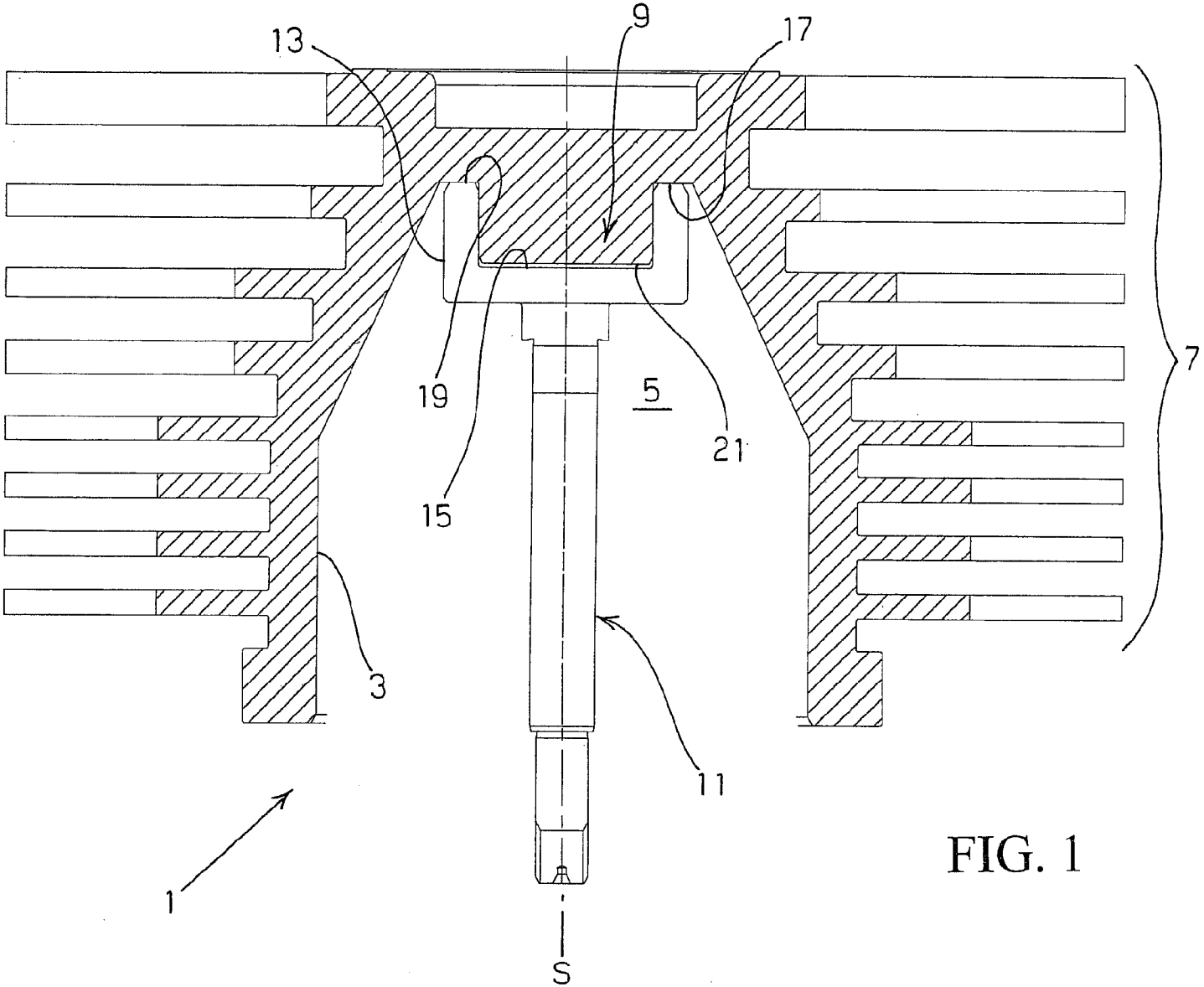
FIG. 1 shows the rotor assembly of a turbomolecular vacuum pump.

Referring to FIG. 1, there is shown a rotor assembly 1 comprising a rotor 3 and a supporting shaft 11. In the illustrated example, which relates to a turbomolecular pump, rotor 3 includes a central bell-shaped cavity 5, intended to house the electric motor of the pump, and a plurality of parallel rotor discs 7, intended to cooperate with corresponding stator discs formed on the stationary part of the pump in order to form pumping stages.

According to the invention, rotor 3 further includes a male projection 9 centrally and axially extending towards the interior of bell-shaped cavity 5. In the illustrated example, projection 9 is cylindrical, but it could even have a different shape, for instance a frusto-conical shape. However, it is evident that, since the rotor assembly is to rotate about axis S of supporting shaft 11 at very high speed while keeping a perfect alignment, it is preferable that the projection has the shape of a solid of revolution, so as to perturb as little as possible the balance of the rotor assembly.

Still referring to FIG. 1, supporting shaft 11 has a coupling end portion 13 for the shaft coupling with rotor 3, which portion is substantially cup shaped and has a cavity 15 arranged to receive projection 9 of rotor 3 and to become engaged therewith. In the illustrated example, cavity 15 has cylindrical shape too.

According to such an embodiment, the proper relative axial positioning of shaft 11 and rotor 3 is obtained through the abutment of end portion 13 of shaft 11 against the rotor surface and, in the illustrated example, against the surface of bell-shaped cavity 5 in the rotor. To this aim, an annular abutment seat 17 is provided around projection 9 of rotor 3, and edge 19 of end portion 13 of shaft 11 abuts against such a seat.

Advantageously, according to the invention, an error preferably lower than 10 μm in the planarity of abutment surface 17 and abutment edge 19 of end portion 13 allows for obtaining an axial positioning precision higher than that attainable with the present solutions using more complex and expensive methods.

Still referring to FIG. 1, according to the invention a first body is prepared of a first material. The rotor 3 having a male axial projection 9 is formed from the first body, preferably by turning. Then a second body is prepared of a second material. The supporting shaft 11 is formed from the second body, preferably by turning. The supporting shaft 11 has an end portion 13 provided with a female cavity 15 whose shape and size are such that the cavity can receive the male projection 9 of rotor 3 with interference at ambient temperature. After that the end portion 13 is heated in order to obtain an expansion of female cavity 15 sufficient to enable the introduction of projection 9 of rotor 3 into the cavity. The male projection 9 is introduced into the female cavity 15; then the end portion 13 is brought back to the ambient temperature for obtaining the contraction of the size of cavity 15 and therefore obtaining a fixed interference coupling between the shaft 11 and the rotor 3.

The method according to the invention further includes corresponding steps of forming an abutment surface 17 and an edge 19 of end portion 13 with a planarity error lower than 10 μm. Advantageously, according to the invention, due to such a feature, rotor is utilized for turbomolecular vacuum pumps with high mechanical characteristics, i.e. capable of being rotated at a speed exceeding $3\times10^4$ rpm and up to about $10^5$ rpm, can be made, without using ancillary securing means such as brazing.

Advantageously, still in accordance with the invention, the axial alignment between rotor 3 and shaft 11 is preferably obtained through the axial abutment between abutment surface 17 and abutment edge 19 only, whereas a gap 21 is left between the bottom of cavity 15 and the end surface of projection 9. In this manner, the area of the surface to be processed to minimise the planarity error is reduced, since it is limited to abutment surface 17 and the corresponding abutment edge 19.

In the illustrated example, which refers to the field of turbomolecular pumps, rotor 3 is made of aluminium or an aluminium alloy, more particularly an alloy of the 2000 or 7000 series, and shaft 11 is made of stainless steel or a steel alloy, more particularly of the 300 or 400 series.

In order to obtain an allowance between projection 9 of rotor 3 and the walls of cavity 15 of shaft 11 sufficient to allow the coupling, it is generally sufficient to heat shaft 11 to temperatures of the order of 200° C., while keeping rotor 3 at ambient temperature of about 20° C.

This allows for attaining multiple aims: first, a single thermal treatment step is required, so that the process is simplified and the costs of manufacturing are reduced, also because use of expensive equipment is dispensed with; second, since the rotor of aluminium alloy is not subjected to any thermal treatment, its mechanical properties are not affected.

As stated before, each turning step can preferably comprise a finishing step to obtain the planarity of abutment surface 17 surrounding projection 9 of rotor 3 and abutment edge 19 of end portion 13 of shaft 11, respectively, so as to allow optimising the axial mutual positioning of the rotor and the shaft.

Experimental tests have demonstrated that the coupling between the rotor and the shaft obtained with the teachings of the invention is easily reversible. Actually, by exploiting the higher thermal expansion/contraction coefficient of aluminium alloys with respect to stainless steel, it is sufficient to subject the rotor assembly to cooling in order to eliminate interference and separating the rotor from the shaft. Experiments have shown that a temperature difference lower than 120° C. is enough to obtain separation of the rotor from the shaft. Thus, in case of geometrical alignment errors during the coupling step, rotor 3 and shaft 11 can be separated and recovered, without producing rejected pieces.

Figure 2:
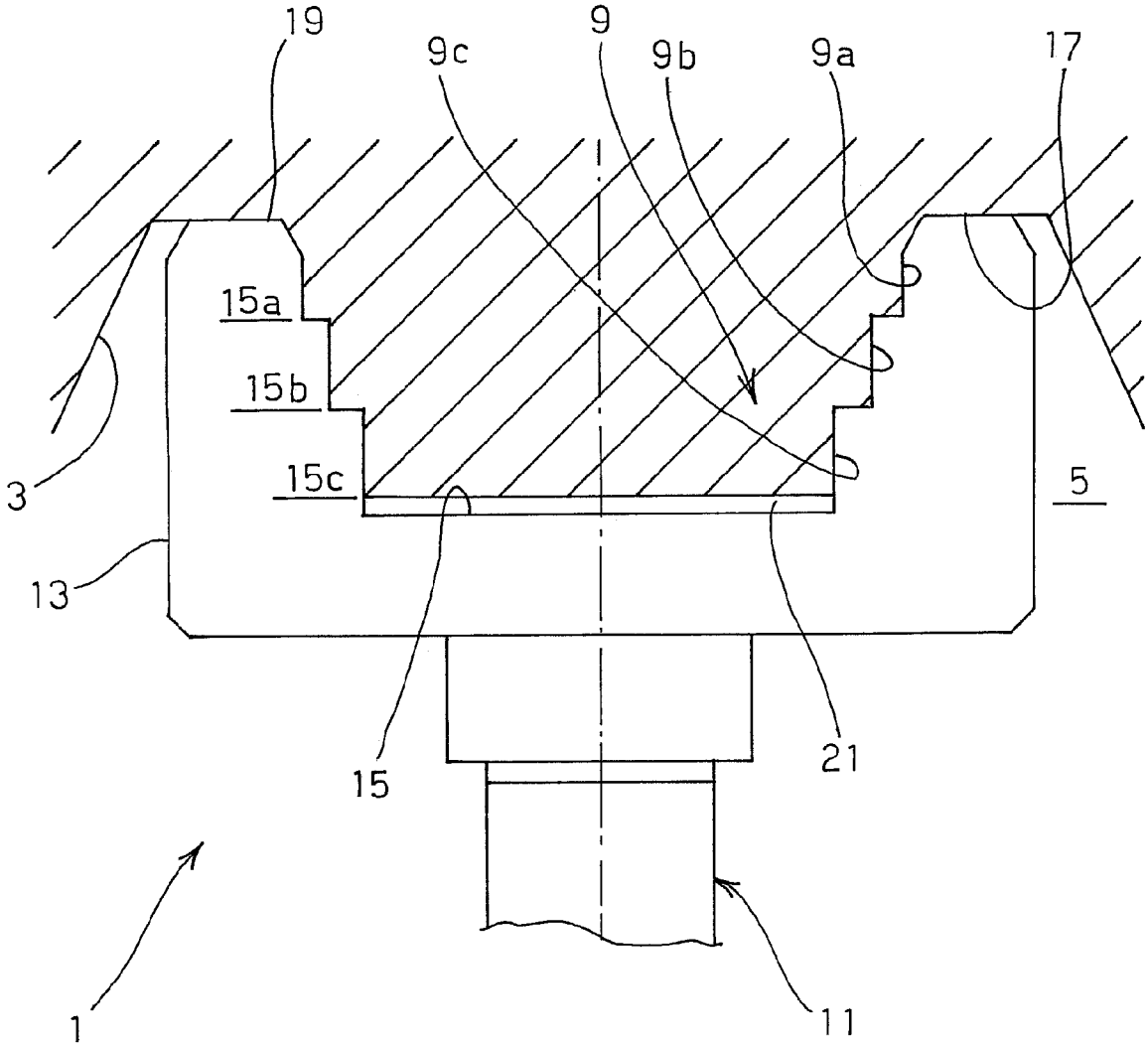
FIG. 2 shows a detail of the rotor assembly of a turbomolecular vacuum pump according to a variant embodiment.

Turning now to FIG. 2, there is shown a variant embodiment of the invention, which allows for making coupling of rotor 3 and shaft 11 easier.

According to this variant embodiment, projection 9 of rotor 3 has not a constant diameter, but it includes cylindrical sections 9*a*, 9*b* and 9*c* the diameters of which progressively decrease as the distance from the base of projection 9 increases. Correspondingly, cavity 15 of shaft 11 includes several cylindrical sections 15*a*, 15*b* and 15*c* the diameters of which progressively decrease in the direction towards the bottom of cavity 15.

The transition surfaces between the different sections 9*a*, 9*b*, 9*c* and 15*a*, 15*b*, 15*c* can be bevelled or inclined so as to form corresponding draft regions for the insertion of projection 9 into cavity 15 when coupling rotor 3 and shaft 11.

The above description clearly shows that the method according to the invention attains the desired objects, in that it allows for manufacturing a rotor assembly for a rotating machine, in particular a turbomolecular vacuum pump, in a simple, cheap and reversible manner.

It is also clear that the above description has been given by way of a non-limiting example and those changes and improvements are possible without thereby departing from the scope of the invention as defined in the appended claims.

What is claimed is:

1. A method of manufacturing a rotor assembly for a rotary vacuum pump, the method comprising the steps of:

providing a first material and forming therefrom a rotor having a male axial projection;

providing a second material and forming therefrom a supporting shaft having an end portion provided with a female cavity of a shape and a size for receiving with interference at an ambient temperature said male axial projection;

heating said end portion for obtaining an expansion of the female cavity sufficient to enable the introduction of the projection of the rotor into said cavity;

introducing said male projection into said female cavity; and cooling said end portion to the ambient temperature, thereby obtaining the contraction of the cavity and obtaining therefore a fixed interference coupling between said shaft and said rotor.

2. The method of claim 1, wherein the step of heating said end portion reduces the interference between said rotor and said shaft and consequently allows for separating said rotor from said shaft.

3. The method of claim l, further comprising forming an abutment surface around the male projection of the rotor and a corresponding abutment edge of the end portion, said abutment surface and abutment edge having a planarity error less than 10 μm.

4. The method of claim 1, wherein said first material is an aluminium alloy.

5. The method of claim 1, further comprising forming the rotor with a male axial projection by turning.

6. The method of claim 5, wherein the turning of the rotor with a male axial projection is followed by a surface finishing to obtain a planarity of an annular abutment seat surrounding the base of said projection.

7. The method of claim 3, wherein an axial alignment between said rotor and said shaft is obtained through an axial abutment between said abutment surface and said abutment edge only, and wherein a gap is formed between a bottom of the female cavity and an end surface of the male projection.

8. The method of claim 1, wherein said second material is steel or a steel alloy.

9. The method of claim 1, further comprising forming a supporting shaft by turning.

10. The method of claim 9, wherein the turning of the shaft is followed by a surface finishing to obtain the planarity of the edge of the end portion.

11. The method of claim 10, wherein said step of heating said end portion comprises heating to a temperature of about 200° C.

12. The method of claim 1, wherein said male projection and said female cavity have cylindrical shape.

13. The method of claim 1, wherein cylindrical sections having diameters progressively decreasing as the distance from the base of the male projection increases are defined in said male projection of said rotor, and wherein corresponding cylindrical sections having diameters progressively decreasing towards the bottom of the cavity is approached are defined in said female cavity.

14. A rotor assembly for a rotary vacuum pump, comprising:

a rotor comprising a male axis projection made of a first material and having a first planar abutment surface formed thereon; and a supporting shaft made of a second material and comprising an end portion with a female cavity of a shape and size for receiving the male axis projection and having a second planar abutment surface disposed in facing relationship to the first planar abutment surface, said first and second planar abutment surfaces having planarity error less than 10 μm, wherein said rotor is securely coupled with said supporting shaft via the steps of heating of the end portion, disposing the male axis projection therein, and subsequent cooling thereof to an ambient temperature whereby the end portion contracts and compresses about said male axis projection.

15. The rotor assembly of claim 14, wherein an axial alignment between said rotor and said shaft is obtained through an axial abutment between the first and second abutment surfaces.

16. The rotor assembly of claim 15, wherein said first material is an aluminum alloy and said second material is stainless steel.

17. The rotor assembly of claim 16, wherein said male projection and said female cavity have cylindrical shape.

18. The rotor assembly of claim 17, wherein said mail projection of said rotor comprises cylindrical sections having diameters progressively decreasing as a distance from a base of the male projection increases and wherein said female cavity comprises corresponding cylindrical sections having diameters progressively decreasing towards a bottom of the cavity.

19. The rotor assembly of claim 18, wherein a gap is formed between a bottom of the female cavity and an end surface of the male projection.

20. The rotor assembly of claim 19, wherein said rotor has a rotation speed exceeding $3\times10^4$ rpm when the rotor assembly is utilized in a turbomolecular vacuum pump.

* * * * *

UNITED STATES PATENT AND TRADEMARK OFFICE

CERTIFICATE OF CORRECTION

PATENT NO. : 8,167,576 B2
APPLICATION NO. : 12/392969
DATED : May 1, 2012
INVENTOR(S) : Gianluca Buccheri et al.

It is certified that error appears in the above-identified patent and that said Letters Patent is hereby corrected as shown below:

On the title page, item (57), under "Abstract", in column 2, line 9, delete "mail" and insert -- male --, therefor.

In column 6, line 35, in Claim 3, delete "claim l," and insert -- claim 1, --, therefor.

In column 8, line 10, in Claim 18, delete "mail" and insert -- male --, therefor.

Signed and Sealed this
Nineteenth Day of June, 2012

David J. Kappos

David J. Kappos
*Director of the United States Patent and Trademark Office*